US005839365A

United States Patent [19]

Calbrix et al.

[11] Patent Number: 5,839,365

[45] Date of Patent: Nov. 24, 1998

[54] PRODUCT GUIDING DEVICE ON A CUTTING-CYLINDER PAIR OF A FOLDING APPARATUS OR FOLDER

[75] Inventors: Jean-Claude Calbrix, Cambronne; Philippe Herda, Longueil St. Marie; Thierry Vauchelle, Ravenel, all of France

[73] Assignee: Heidelberger Druckmaschinen AG, Heidelberg, Germany

[21] Appl. No.: 898,733

[22] Filed: Jul. 23, 1997

[30] Foreign Application Priority Data

Jul. 23, 1996 [FR] France ..... 96 09208

[51] Int. Cl.[6] ..... B41F 13/56

[52] U.S. Cl. ..... 101/226; 101/227

[58] Field of Search ..... 101/219, 224, 101/225, 226, 227, 228; 493/400, 405, 357

[56] References Cited

U.S. PATENT DOCUMENTS

| | | | |
|---|---|---|---|
| 2,110,585 | 3/1938 | Barber . | |
| 2,487,404 | 11/1949 | Zuckerman . | |
| 4,765,240 | 8/1988 | Kraus et al. | 101/216 |
| 4,870,900 | 10/1989 | Robertson | 101/216 |
| 5,036,737 | 8/1991 | Glaser . | |
| 5,273,515 | 12/1993 | Fenske . | |
| 5,320,042 | 6/1994 | Schwöpfinger . | |
| 5,537,922 | 7/1996 | Becker | 101/216 |
| 5,613,438 | 3/1997 | Rehberg | 101/216 |

FOREIGN PATENT DOCUMENTS

| | | | |
|---|---|---|---|
| 0 400 596 A2 | 12/1990 | European Pat. Off. . | |
| 0 625 476 A1 | 11/1994 | European Pat. Off. . | |
| 1 135 717 | 5/1957 | France . | |
| 678472 | 7/1939 | Germany . | |
| 197806 | 6/1978 | Germany | 101/219 |

*Primary Examiner*—Eugene H. Eickholt
*Attorney, Agent, or Firm*—Herbert L. Lerner; Laurence A. Greenberg

[57] ABSTRACT

A folder having a cutting-cylinder pair with two cutting cylinders for cutting a vertically fed material web into products, and downline transport tape lines guidable over deflecting rollers for onwardly passing the cut-off products therebetween, and including a product guiding device assigned to the cutting-cylinder pair and extending at least partly over the width of the material web, the product guiding device bridging a region extending from an outlet nip of the cutting cylinder pair to an inlet region of the transport tapes.

7 Claims, 5 Drawing Sheets

PRODUCT GUIDING DEVICE ON A CUTTING-CYLINDER PAIR OF A FOLDING APPARATUS OR FOLDER

BACKGROUND OF THE INVENTION

FIELD OF THE INVENTION

The invention relates to a product guiding device on a cutting-cylinder pair of a folding apparatus or folder, such as a pinless or needle-less folding apparatus, a web being feedable vertically to the cutting-cylinder pair which is followed downline by transport tape lines for guiding products therebetween, the transport tape lines being guidable over deflecting rollers.

The published European Patent Document EP 0 400 596 B1 discloses a cutting device for a folding unit of a printing machine.

Transport tape lines are connected downline from a cutting device for a folding unit of a printing machine having two cutting cylinders for a vertically fed web. The transport tape lines run over deflecting rollers and guide the cut-off products therebetween farther on. In order to provide guidance ensuring that the products run in precisely between the transport tape lines on both sides of the incoming web, blower nozzles are provided which are directed into a gap between the web and the cutting cylinders, the cutting cylinders being formed with grooves for passing blast air therethrough parallel to the web. Underneath the cutting cylinder pair, in the region of the deflecting rollers which deflect the transport tape lines, suction nozzles are provided, which suck away the air passing through the grooves.

This heretofore known construction is intended to prevent the cut-off or severed product from becoming caught when it is cut on the cutting cylinders, however, the blast air/suction air construction sketched in the foregoing European patent document is quite complicated and susceptible to external influences.

SUMMARY OF THE INVENTION

It is accordingly an object of the invention to provide a product guiding device on a cutting-cylinder pair of a folder or folding apparatus due to which copies severed in a cutting device are able to run exactly, i.e., with precision, into transport devices arranged downline from the cutting device.

With the foregoing and other objects in view, there is provided, in accordance with the invention, a folder having a cutting-cylinder pair with two cutting cylinders for cutting a vertically fed material web into products, and downline transport tape lines guidable over deflecting rollers for onwardly passing the cut-off products therebetween, and including a product guiding device assigned to the cutting-cylinder pair and extending at least partly over the width of the material web, the product guiding device bridging a region extending from an outlet nip of the cutting cylinder pair to an inlet region of the transport tapes.

In accordance with another feature of the invention, the inlet region of the transport tapes is funnel-shaped and is formed by first and second guides.

In accordance with a further feature of the invention, a plurality of product guide parts, respectively, are assigned to edge regions of the cutting-cylinder pair.

In accordance with an added feature of the invention, the inlet region between the transport tapes is transversely adjustable.

In accordance with an additional feature of the invention, the product guiding device includes an adjustable roller for adjustably setting the inlet region, respectively, narrower and wider.

In accordance with yet another feature of the invention, sides of the guiding device facing towards the material web are formed with a coating for preventing a deposition of ink thereon.

In accordance with a concomitant feature of the invention, the folder is pinless and has a plurality of cutting cylinder groups, respectively including a cutting-cylinder pair for severing copies from a material web, a respective product guiding device being arranged at the exit region of each of the plurality of cutting cylinder groups.

The advantages associated with the foregoing inventive constructions reside, on the one hand, in that the products emerging from the cutting-cylinder nip run into a product guide which is widened into a funnel shape, so that a turning-over or dog-earing of corners of the product at high speeds due to air resistance is not possible. This plays a prominent part, in particular, in the case of web strands or streams formed of several layers of thin papers. Because the leading edges of the copies, which are surrounded on both sides by the product guiding device, are then able to enter without path deviations into the space between succeeding transport tapes, the spacing of the copies from one another also remains constant during the transfer from the cutting-cylinder pair into the inlet funnel of the transport tapes, which is beneficial to further processing in a needle-less or pinless folding apparatus, because a prerequisite for the latter is a precisely cycled product feed.

In a further refinement of the concept upon which the invention of the instant application is based, the product guiding device includes first and second guides which form a funnel-shaped inlet into the product guiding device. In an alternative embodiment, the product guiding device includes two product guiding parts, which are respectively assigned to edge regions of the cutting-cylinder pair. In this embodiment, the center of the leading edge of the copy is not surrounded by lateral product guides. The inlet region, which is arranged downstream of the product guiding device, between the transport tapes which are arranged downline of the cutting-cylinder pair, can be adjusted and adapted to various material web thicknesses, depending upon whether the longitudinally-folded web is composed of very thick printing material or whether a material web which is composed of a plurality of very thin web strands or streams is being processed. To this end, one of the transport tapes can be placed or set by an adjustable roller closer to the other tape in the inlet region between the transport tapes, or further apart from the other. This causes the deflected transport tape to come into contact with the opposite transport tape at an earlier or at a later point in time; in this manner, the width of the inlet region of the transport tapes may be varied.

The sides of the product guiding device which face towards the material web surfaces can be provided with an ink-repelling coating preventing the deposition of ink thereon.

Other features which are considered as characteristic for the invention are set forth in the appended claims.

Although the invention is illustrated and described herein as embodied in a product guiding device on a cutting cylinder pair of a folder or folding apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
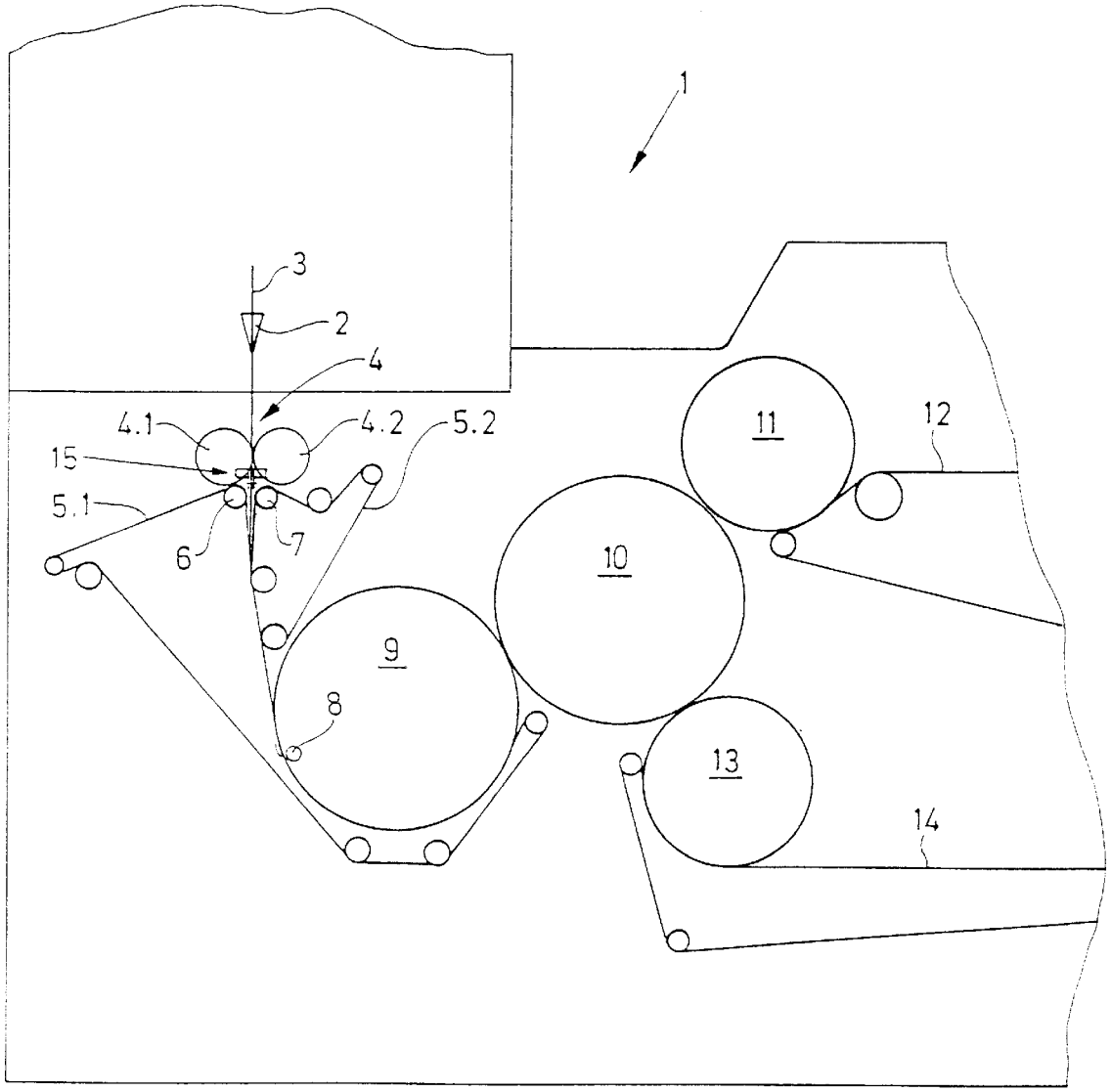
FIG. 1 is a diagrammatic side elevational view of a folder or folding apparatus having a cylinder configuration which includes a cutting-cylinder pair, downline of which a product guide is arranged.

Referring now to the drawings and, first, particularly to FIG. 1 thereof, there is shown therein a cylinder configuration of a folder or folding apparatus 1, and a material web 3 running into the folding apparatus, for example, via a diagrammatically represented funnel 2. A cutting-cylinder pair 4 is provided which includes a knife cylinder 4.1 and a further cutting cylinder 4.2 for severing copies from the material web 3. Located underneath the cutting-cylinder pair 4 are mutually cooperating transport tapes 5.1 and 5.2 which run around respective deflecting or guide rollers 6 and 7 and transport the copies severed in a nip of the cutting cylinders to a tucker blade cylinder 9. Grippers 8 are provided on the tucker blade cylinder 9 for accepting leading edges of the products and for fixing the products in such manner on the circumference of the tucker blade cylinder 9. In the transfer region, the products can then, for example, be transferred by tucker blades or folding knives into corresponding folding jaws of a jaw cylinder 10 in order to form a first transverse fold. After the products have passed onto the circumference of the jaw cylinder 10, further transverse folding operations can be performed in cooperation with upper or lower transfer cylinders 11 and 13, as viewed in FIG. 1, and copies which have been folded many times transversely can be deposited onto tape runs 12 and 14. On the other hand, copies formed with single transverse folds can also be picked off from the jaw cylinder 10 by the transfer cylinders 11 and 13 and deposited onto the appropriate tape runs 12 and 14 , however, this is not the subject matter of the invention of the instant application.

Figure 2:
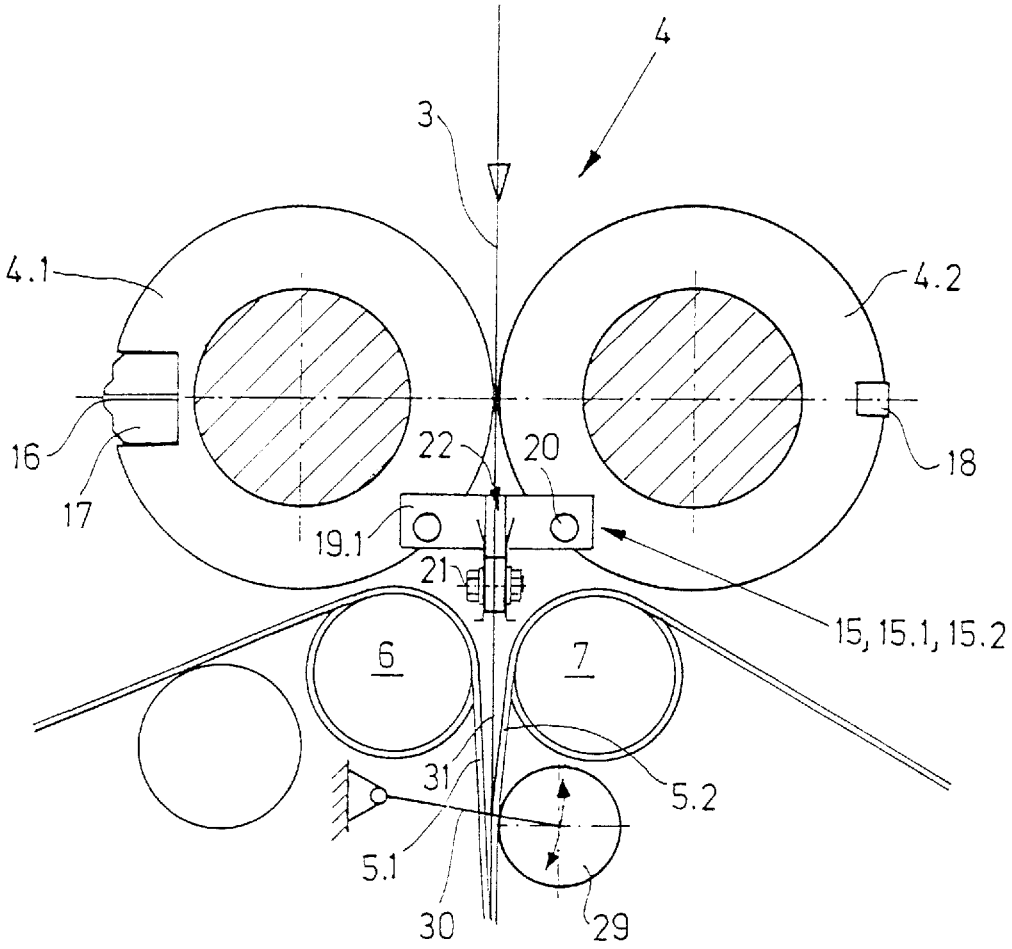
FIG. 2 is an enlarged fragmentary view of FIG. 1 showing, underneath the cutting-cylinder pair, a transfer region to an inlet region to transport tapes, one of which is outwardly deflectable.

FIG. 2 shows, on an enlarged scale, the region underneath the cutting-cylinder pair 4 extending to an inlet region 31 located between the transport tapes 5.1 and 5.2. A knife cylinder 4.1 of the cutting-cylinder pair 4 is provided on the circumference thereof with, for example, one cutting knife 16, which is accommodated in a holder 17. One or more bars or beams 18 provided on the cutting cylinder 4.2 for cooperating with the cutting knife or knives 16 of the knife cylinder 4. The actual number of the bars or beams 18 is defined by the actual number of cutting knives 16 on the knife cylinder 4.1 which, in the case shown in FIG. 2 is one each. Provided underneath the cutting-cylinder nip is a product guide 15; 15.1, 15.2 having an inlet funnel 22. The precise configuration of the product guide 15; 15.1, 15.2 is more readily apparent from the views of FIGS. 4 and 5.

Figure 4:
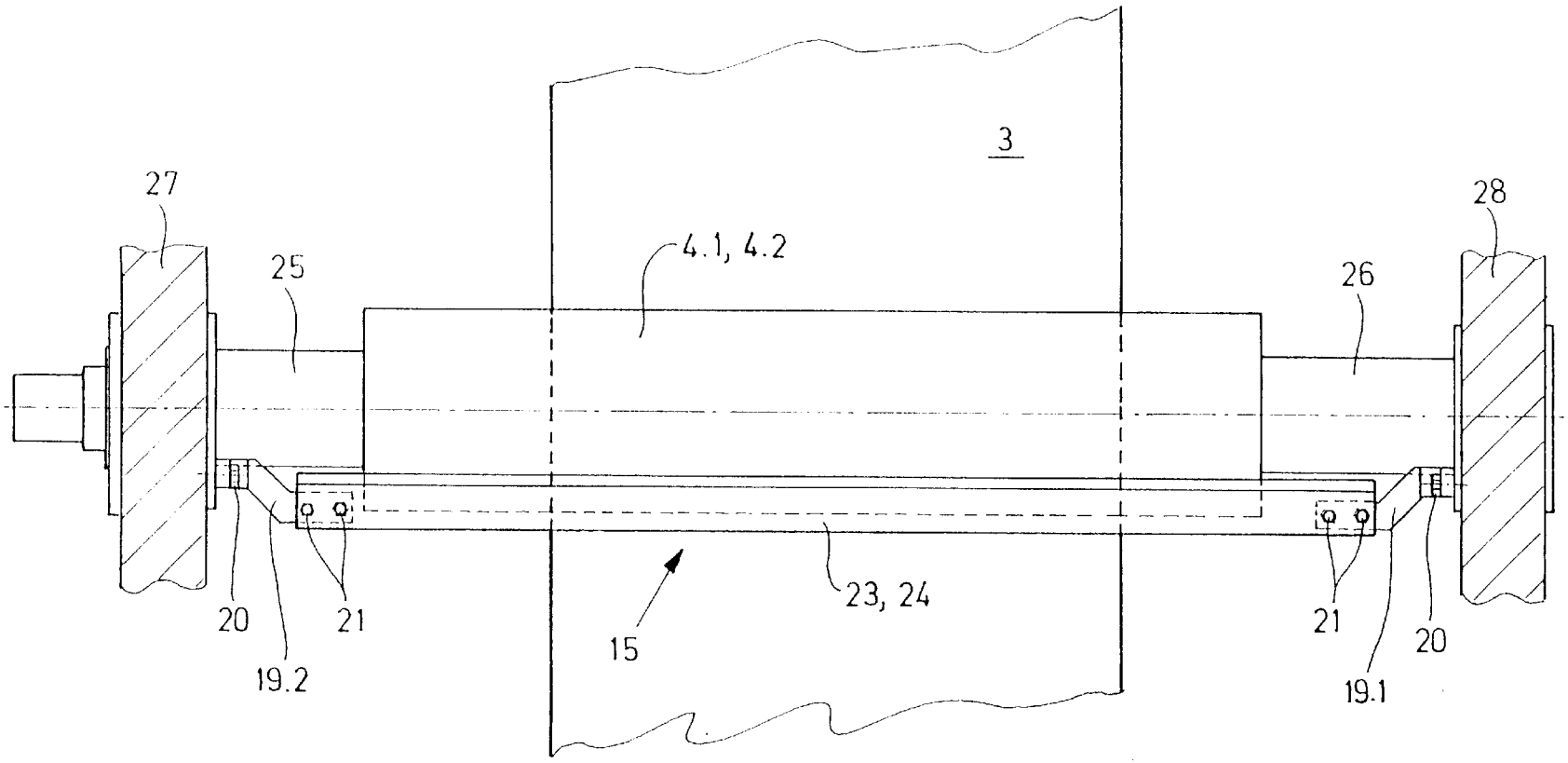
FIG. 4 is a somewhat reduced fragmentary side elevational view of FIG. 2 wherein the product guide underneath the cutting-cylinder pair is constructed as a unipartite product guide.
Figure 5:
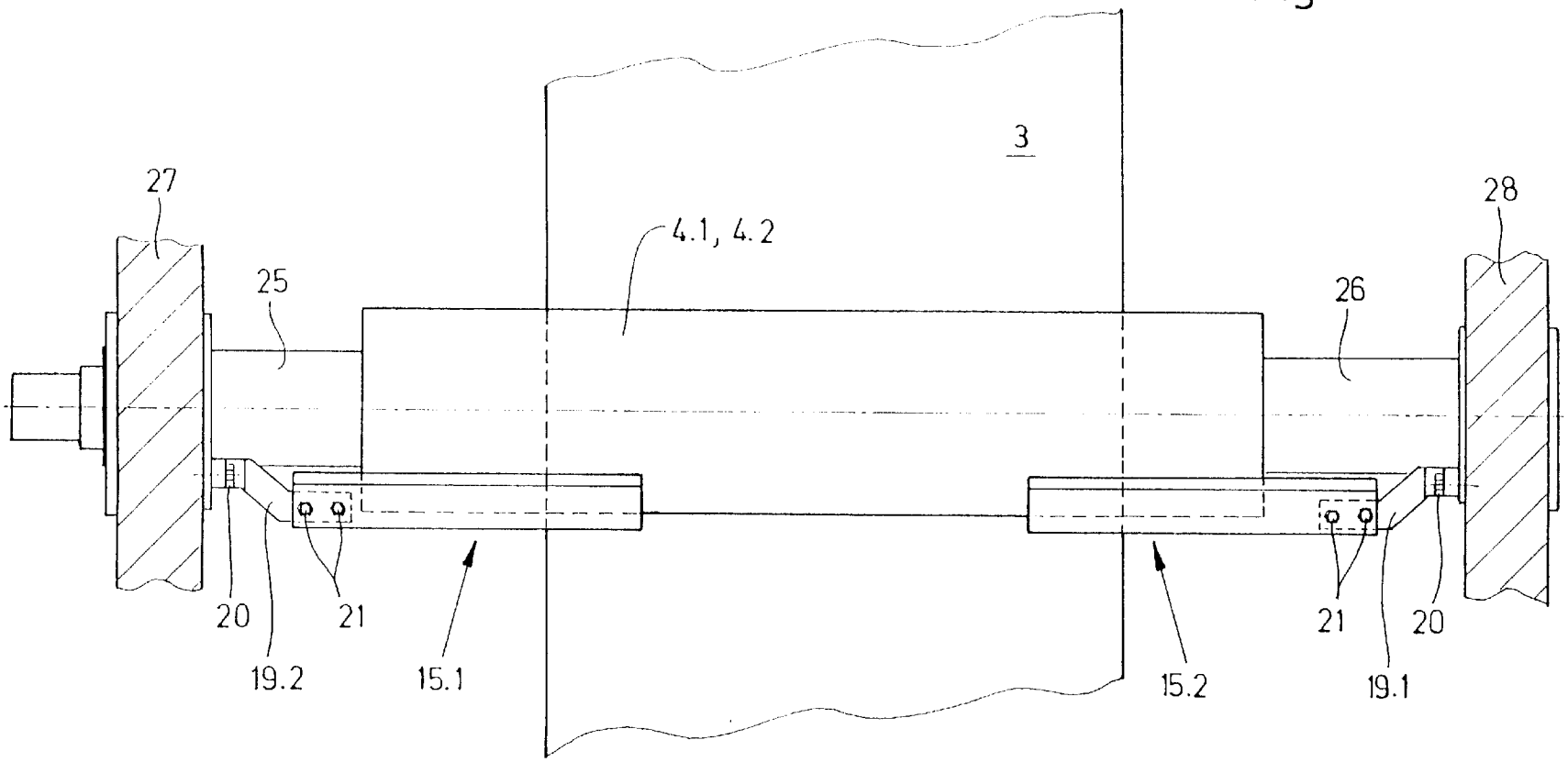
FIG. 5 is a view like that of FIG. 4 showing another embodiment of the product guide which is formed of two product-guiding parts.

The product guide 15; 15.1, 15.2 is threadedly secured to side walls of the folding apparatus via bearing supports 19.1, 19.2, as shown in FIGS. 4 and 5, for example. Underneath the cutting-cylinder nip, a leading edge of the product cut from the material web 3 runs through the widened inlet funnel 22 into the product guide 15; 15.1, 15.2 and prevents the leading edge from fluttering due to air resistance. After the leading edge of the products passes through the product guide 15; 15.1, 15.2, the leading edge runs into the inlet funnel 31 between the two transport tapes 5.1 and 5.2. The product guide 15; 15.1, 15.2 is consequently arranged in the critical transport region underneath the cutting-cylinder pair and above the transport tapes 5.1 and 5.2 and bridges over the latter. It is then no longer possible for the preceding leading edge of the respective product to escape from the vertically running web feeding plane.

In particular, for high production speeds, at which the air resistance acting upon the preceding leading edge of the respective product is very significant, the product guide 15, 15.1, 15.2 prevents the leading edge from opening and spreading out. This can occur quite easily, in particular, if the material web 3 is composed of a plurality of web strands or streams of very thin papers. A result thereof, when the preceding leading edge of the respective product opens, is that the corners thereof turn over or become dog-eared; the succeeding transport tapes 5.1 and 5.2 press the dog-eared corners regularly into the copies, and the copy must be scrapped, because no customer is willing to take such a copy. The concept upon which the invention is based provides a remedy for this circumstance.

The funnel-shaped inlet region 22 ensures that the preceding leading edge of the respective product does not open, but runs through the free space in the vertical direction, so that the product leading edge runs correctly into the inlet funnel 31 between the mutually cooperating transport tapes 5.1 and 5.2.

A second aspect which is supported by the invention is significant, in particular, in the case of pinless or needle-less folding apparatuses; the construction according to the invention of the instant application prevents the material web 3 from leaving the predetermined conveyor or feed path thereof in the vertical direction into the inlet funnel 31 between the transport tapes 5.1 and 5.2. If the preceding leading edge of the respective were to deviate from the feed path thereof, different entry times for the product into the space between the transport tapes 5.1 and 5.2 would occur. The result thereof would be irregular spacing of the copies from one another. However, in the case of folders or folding apparatuses which operate without pins or needles, this would be associated with considerable difficulties, because a requisite of these apparatuses is a strictly cyclic product feed, in order for example to ensure the entry of copies into pockets of a rotating fan fly or delivery always at the same instant of time.

Depending upon the thickness of the material web 3 to be processed, the inlet funnel 31 can be widened or narrowed between the transport tapes 5.1 and 5.2 by an adjustable roller 29. The adjustable roller 29 engages behind one of the transport tapes 5.1 and 5.2 running around the deflecting or guide rollers 6 and 7 and, in accordance with the respective movement in the direction of the double-headed arrow shown in FIG. 2, sets the belt closer to the opposite transport belt or farther away from the latter. In this manner, due to the roller 29 pivotable by a lever 30, an adaptation or adjustment of the width of the inlet region 31 to the respective thickness of the material web 3 to be processed is provided.

Figure 3:
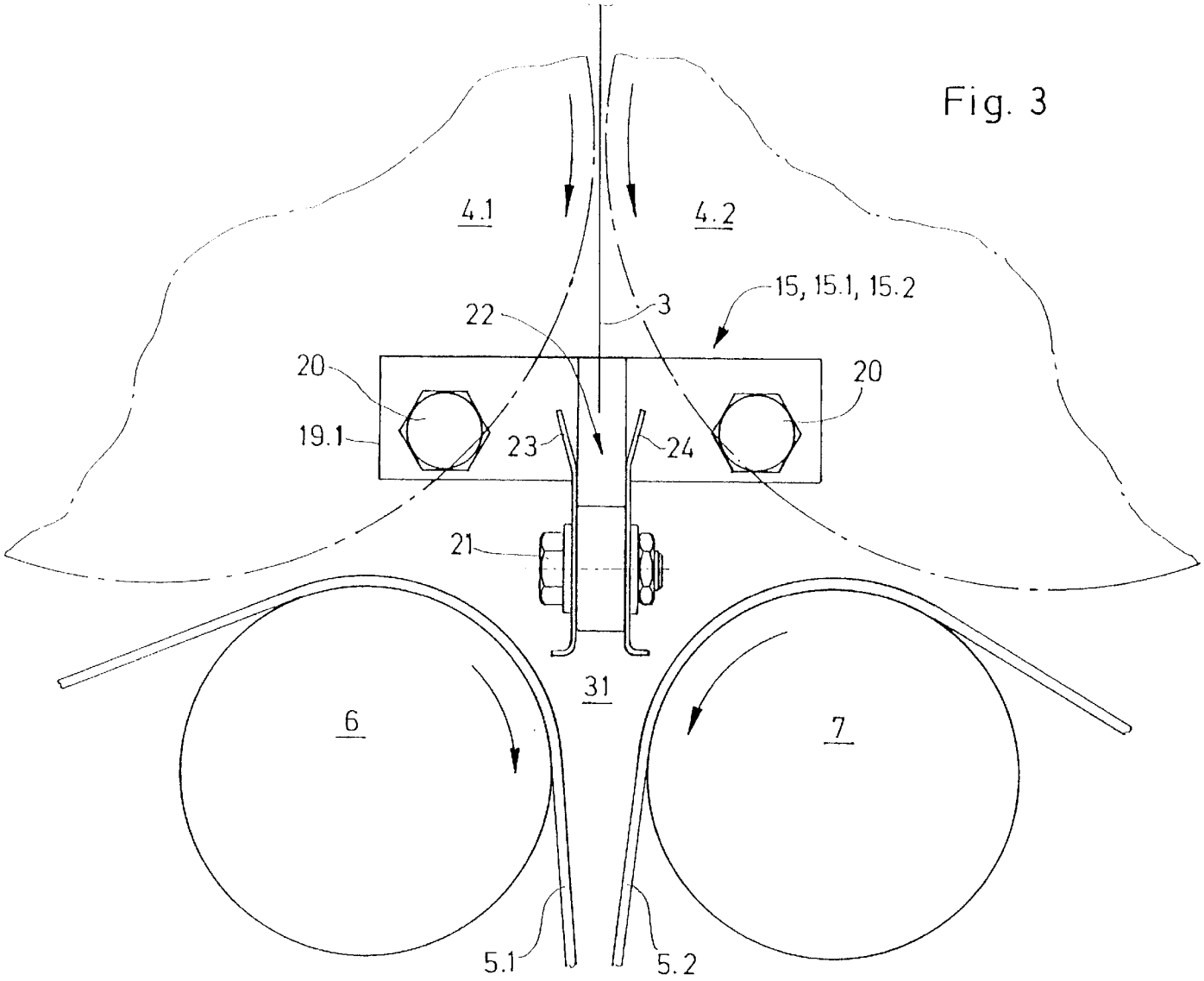
FIG. 3 is an enlarged fragmentary view of FIG. 2 showing the product guide in greater detail.

FIG. 3 is an enlarged view of the product guide. The knife cylinder 4.1 and the cutting cylinder 4.2, respectively, rotating in the direction of the curved arrows associated therewith, feed the leading edge of the respective product severed from the material web 3 into the product guide 15; 15.1 and 15.2. The inlet funnel 22 is formed by two profiles extending parallel to one another, namely a first and a second guide 23 and 24. The width of the passage gap for the leading edge of the product cut from the material web 3 to be fed is predefined by the spacing of the first and of the second guide 23 and 24 from one another, as is readily apparent from FIG. 3 in the region of the bolts 21. The product guide 15; 15.1, 15.2 is accommodated by bearing brackets secured to the side walls of the folding apparatus 1, only one bearing bracket 19.1 thereof being shown in FIG. 3. The bearing bracket 19.1 is fastened by screws or bolts 20 to a side wall of the folding apparatus 1.

Illustrated underneath the product guide 15; 15.1, 15.2 are the transport tapes 5.1 and 5.2, into the inlet funnel 31 of which the leading edge of the product severed from the material web 3 moves. The sides of the first and the second guides 23 and 24 which face the material web surfaces can be provided with an ink-repellent coating which prevents the deposition of ink thereon.

FIG. 4 is a side elevational view of a unipartite product guide 15. The cutting-cylinder pair 4, made up of the knife cylinder 4.1 and the cutting cylinder 4.2, is supported in side walls 27 and 28 of the folding apparatus 1. Underneath cylinder journals 25 and 26, the bearing brackets 19.1 and 19.2 are fastened by the respective screws or bolts 20 to the respective side walls 27 and 28 of the folding apparatus 1. The first and second guides 23 and 24 are connected to the respective bearing brackets 19.1 and 19.2 by bolts 21, which space the two profiles apart from one another. In the exemplary embodiment shown in FIG. 4, the product guide 15 extends over the entire width of the cutting cylinder pair 4.

Illustrated in FIG. 5 is an alternative to the unipartite product guide according to FIG. 4. A product guide formed of two guide parts 15.1 and 15.2, which are fastened to the bearing brackets 19.1 and 19.2, respectively, extend only into the edge regions of the cutting-cylinder pair 4. In a manner analogous to the embodiment already shown in FIG. 4, the bearing brackets 19.1 and 19.2 are fastened by screws or bolts 20 to the respective side walls 27 and 28 of the folding apparatus. The shorter profile pieces 15.1 and 15.2 shown in FIG. 5 are connected by the bolts 21 to the respective bearing brackets 19.1 and 19.2, and the sides thereof facing towards the material web 3 can be provided with a coating preventing the deposition of ink thereon.

We claim:

1. A folder having a cutting-cylinder pair with two cutting cylinders for cutting a vertically fed material web into products, and downline transport tape lines guidable over deflecting rollers for onwardly passing the cut-off products therebetween, and comprising a product guiding device assigned to the cutting-cylinder pair and extending at least partly over the width of the material web, said product guiding device bridging a region extending from an outlet nip of the cutting cylinder pair to an inlet region of the transport tapes.

2. The product guiding device according to claim 1, wherein said inlet region of the transport tapes is funnel-shaped and is formed by first and second guides.

3. The product guiding device according to claim 1, comprising a plurality of product guide parts, respectively assigned to edge regions of the cutting-cylinder pair.

4. The product guiding device according to claim 1, wherein said inlet region between the transport tapes is transversely adjustable.

5. The product guiding device according to claim 4, including an adjustable roller for adjustably setting said inlet region, respectively, narrower and wider.

6. The product guiding device according to claim 1, wherein sides of the guiding device facing towards the material web are formed with a coating for preventing a deposition of ink thereon.

7. The folder according to claim 1, being pinless and having a plurality of cutting cylinder groups, respectively comprising a cutting-cylinder pair for severing copies from a material web, a respective product guiding device being arranged at the exit region of each of the plurality of cutting cylinder groups.

* * * * *